US008851534B2

(12) United States Patent
Fiedler

(10) Patent No.: US 8,851,534 B2
(45) Date of Patent: Oct. 7, 2014

(54) MAGNETIC CLOSURE WITH AN OPENING-ASSISTING SPRING

(75) Inventor: Joachim Fiedler, Berlin (DE)

(73) Assignee: Fidlock GmbH, Hannover (DE)

( * ) Notice: Subject to any disclaimer, the term of this patent is extended or adjusted under 35 U.S.C. 154(b) by 1184 days.

(21) Appl. No.: 12/668,739

(22) PCT Filed: Jul. 12, 2008

(86) PCT No.: PCT/DE2008/001161

§ 371 (c)(1),
(2), (4) Date: Jun. 14, 2010

(87) PCT Pub. No.: WO2009/006888

PCT Pub. Date: Jan. 15, 2009

(65) Prior Publication Data

US 2011/0167595 A1 Jul. 14, 2011

(30) Foreign Application Priority Data

| | | |
|---|---|---|
| Jul. 12, 2007 | (DE) | 10 2007 032 566 |
| Jul. 12, 2007 | (DE) | 10 2007 032 567 |
| Jul. 17, 2007 | (DE) | 10 2007 033 277 |
| Apr. 15, 2008 | (DE) | 10 2008 019 063 |

(51) Int. Cl.
*E05C 19/16* (2006.01)

(52) U.S. Cl.
USPC ..... 292/251.5; 220/230; 24/303

(58) Field of Classification Search
None
See application file for complete search history.

(56) References Cited

U.S. PATENT DOCUMENTS

| | | | | |
|---|---|---|---|---|
| 4,270,781 | A | 6/1981 | Nishimura | |
| 2006/0049645 | A1 * | 3/2006 | Drumm | 292/251.5 |

FOREIGN PATENT DOCUMENTS

| | | | |
|---|---|---|---|
| DE | 3631092 | A1 | 4/1987 |
| DE | 19642071 | A1 | 4/1998 |
| GB | 1530591 | | 11/1978 |
| WO | 9218028 | A1 | 10/1992 |
| WO | 2008006357 | A2 | 1/2008 |

* cited by examiner

*Primary Examiner* — Jack W. Lavinder
(74) *Attorney, Agent, or Firm* — The Webb Law Firm

(57) ABSTRACT

A magnetic closure comprises a magnet-armature structure having a magnet and an armature, the magnet and the armature being constituted such that, for an automatic closing, the armature and the magnet mutually attract each other in a closing direction below a predetermined minimum distance, and, for an opening, the magnet is laterally shifted or rotated with respect to the armature into an open position so that the surfaces of magnet and armature facing each other in a mutually attracting manner become smaller, whereby the force of attraction between magnet and armature comes smaller, Further, an opening-assisting spring is provided for assisting the opening, wherein the opening-assisting spring either is automatically pretensioned by the magnetic force during the automatic closing, or is pretensioned during the opening operation.

2 Claims, 30 Drawing Sheets

A-A
5
1
3
4
2
A
A
3
4

A-A
5
4
A
A
3,4

Fig 1e
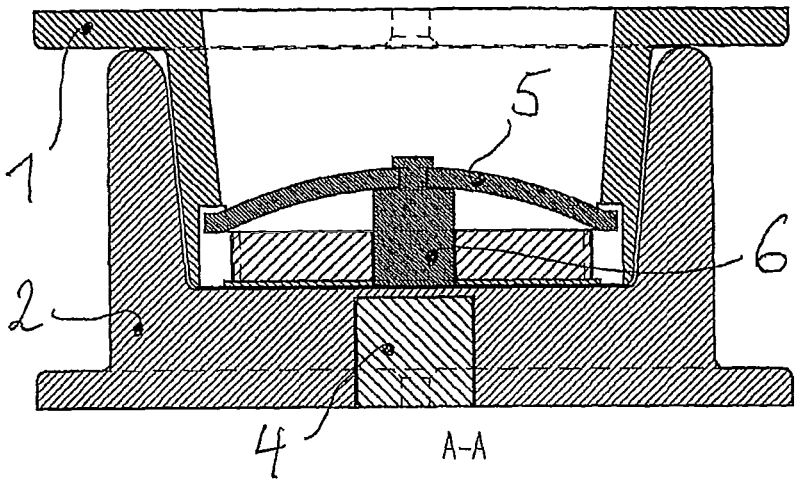
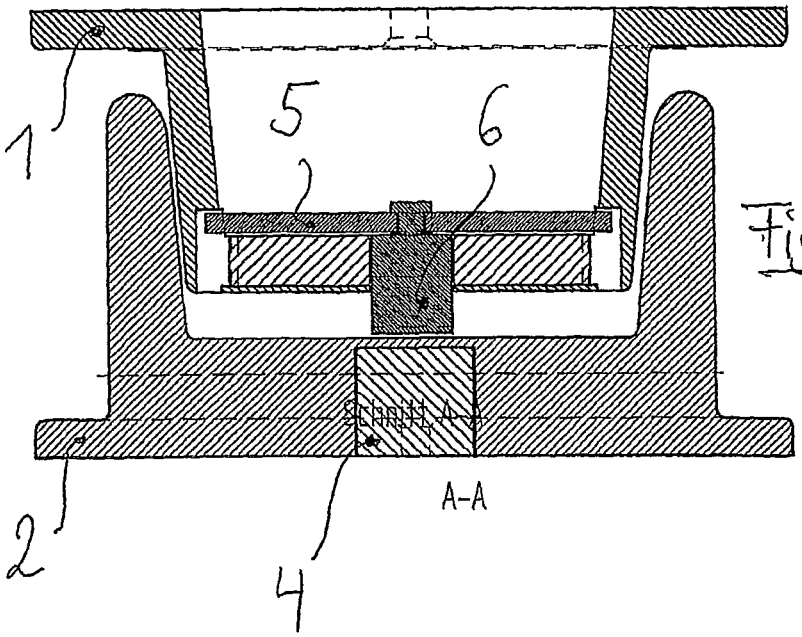
Fig 1f

Fig 3c
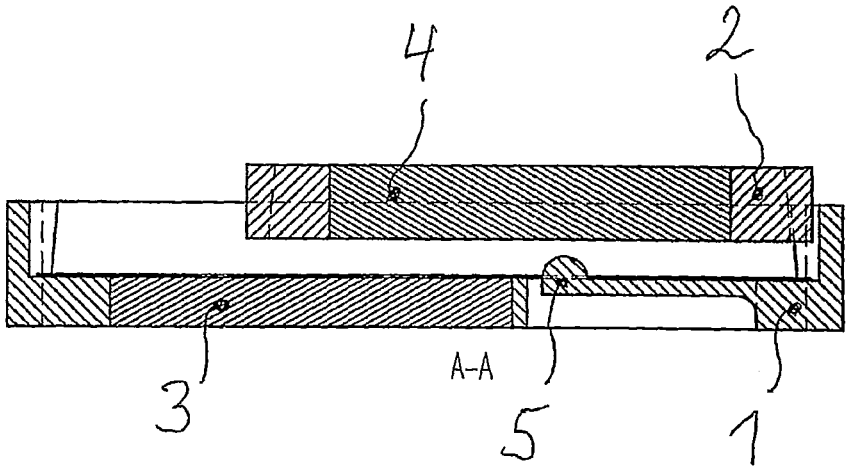
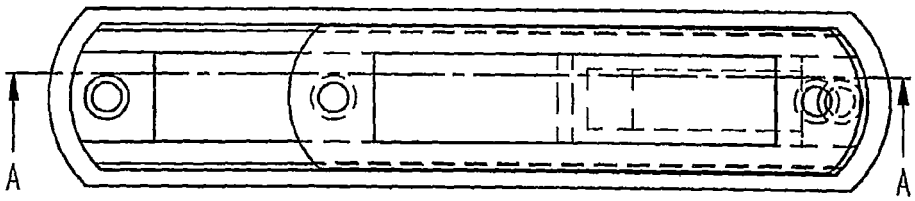

2
8
9
5a
12
10
1

11c
10c
5c 1
3
4
2
11c'
10c'
5c'
A–A 11c
10b
5b 1
3
4
2
11c'
10b'
A–A
5b'

MAGNETIC CLOSURE WITH AN OPENING-ASSISTING SPRING

CROSS-REFERENCE TO RELATED APPLICATIONS

This application is a National Phase Patent Application of International Patent Application Number PCT/DE2008/001161, filed on Jul. 12, 2008, which claims priority of German Patent Application Number 10 2007 032 567.5, filed on Jul. 12, 2007, of German Patent Application Number 10 2007 032 566.7, filed on Jul. 12, 2007, of German Patent Application Number 10 2007 033 277.9, filed on Jul. 17, 2007, and of German Patent Application Number 10 2008 019 063.2, filed on Apr. 15, 2008.

BACKGROUND OF THE INVENTION

1) Field of the Invention

This invention relates to a magnetic closure which connects flexible or also fixed elements with each other, such as e.g. a closure on a handbag.

2) Description of the Prior Art

From the prior art magnetic closures are known, which attract each other on closing, but are rotated or shifted against each other for opening. These closures have the advantage that they can be opened more softly as compared to the case where the closure has to be pulled apart in the same direction in which it contracts on closing. Such a magnetic closure is described in the document DE 196 42 071 A1. In this construction, the armature is completely pushed off from the magnet during the opening movement, so that closures of this type can be opened almost without force.

However, such closures often have no optimum haptics, wherein haptics is understood to be the property of how a closure feels when opened, but also when closed, if it is actuated manually. The cause for such poor haptics is the fact that upon complete separation of the closure halves a rest of the magnetic force mostly has yet to be overcome, so that a jerky haptics is obtained, as in contrast to the structure from DE 196 42 071 A1 sufficient shifting path is not always available for laterally shifting armature and magnet, until the magnetic force acting between armature and magnet is almost zero. Therefore, the last opening movement must be effected opposite to the closing movement.

To overcome this deficiency, magnetic closures are known from the prior art, which operate according to the principle of the polable magnet systems. By rotating or shifting the magnet systems against each other, i.e. when performing the opening movement, the magnet systems are moved into a mutually repelling opposed position. Opening the closure thereby is supported comfortably, and the haptics is distinctly improved. However, these closures are expensive in production, since a multitude of magnets or expensive multi-pole magnetizations of the magnets are required.

An improvement of the haptics on closing of a magnetic closure is described in the document DE3631092. There is provided a spring which is arranged between armature and magnet, and after closing generates a force directed opposite to the magnetic field, in order to reduce the impact noise on closing. Despite the advantage achieved on closing, this closure has no good haptics on opening, as it must be separated with a strong jerk. The reason for this is that the magnet is separated opposite to the closing direction and thus has the typical jerky force characteristic of a magnet with maximum force of attraction in closing position and strongly non-linearly decreasing force of attraction with increasing distance of armature and magnet.

SUMMARY OF THE INVENTION

It is an object of the invention to provide a magnetic closure which has a good haptics, can be built in a compact way and can be manufactured at low cost.

This object is solved with a magnetic closure comprising a magnet-armature structure with the following features: A magnet and an armature are formed such that the armature and the magnet mutually attract each other for the automatic closing of the magnetic closure, which of course requires a predetermined minimum distance. This attraction is effected in a closing direction—which is not the opposite opening direction, as for opening the magnet is laterally shifted or rotated with respect to the armature.

On closing, a magnet surface attractingly faces an armature surface. The magnet, the armature and in particular the surfaces attracting each other are dimensioned such that the desired attraction and the desired closing force are achieved. When the closure is closed, an armature surface and a magnet surface contact each other or face each other with a close spacing.

When the armature is laterally pushed off from the magnet for opening, the surface with which the armature faces the magnet is reduced, whereby the force of attraction between magnet and armature also becomes smaller. This shifting or rotation is performed up to the opening position, in which the surfaces of magnet and armature facing each other have the smallest size.

Since the above-described combination of features is known from the prior art, an even more detailed description can be omitted. The person skilled in the art also knows that an armature can also be a second magnet.

Hence, an opening-assisting spring is provided to assist the opening operation. The opening-assisting spring is tensioned at the time of opening and acts against the remaining magnetic force, so that depending on the magnitude of this spring force, jerky opening of the closure can be reduced or be avoided completely. The tensioning of the opening-assisting spring can be effected at different times. It is possible to tension the opening-assisting spring already on closing or only when opening the closure.

If the tensioning of the opening-assisting spring should be effected on closing, the structure is formed such that the opening-assisting spring is tensioned by the magnetic force acting between magnet and armature during the closing operation. When the magnetic closing force then is decreasing on opening, i.e. when laterally shifting or rotating the magnet with respect to the armature, an additional weakening of this closing force is effected by the spring force acting in opposite direction. If in the opening position of the closure the remaining magnetic closing force is just as great as the spring force, the two forces cancel each other out, so that the closure can be separated without force.

If the tensioning of the opening-assisting spring should only be effecting on opening, the structure is formed such that the opening-assisting spring is pretensioned on opening, i.e. when laterally shifting or rotating the magnet with respect to the armature, the opening-assisting spring is pretensioned by the force to be applied for this purpose.

In one embodiment, the acting spring force of the opening-assisting spring in the opening position is greater than the remaining force of magnetic attraction between the closure halves. It thereby is achieved that the closure halves separate on their own, so that approximately the same haptics is achieved which is known from the polable magnetic closures, in which the closure halves are actively urged apart by the force of magnetic repulsion.

In one embodiment, the opening-assisting spring first is pretensioned, before shifting or rotating between magnet and armature starts. When shifting or rotating between magnet and armature has started, the spring force acting against the magnetic force likewise effects an improvement of the opening haptics.

In another embodiment, the opening-assisting spring is configured in the form of at least two adjacent detent springs with rising beveled detents or as an open detent spring washer with an at least two-flight thread with beveled flights.

The detent springs or the detent spring washer snap in on closing due to the magnetic force and thus additionally positively secure the closure and during opening also serve as opening-assisting springs. This is effected by the cooperation with likewise beveled flights or linearly rising beveled detent lugs on the movable connecting module, in that due to shifting in the direction of the pitch of the detent lugs the beveled spring catches urge the detent lugs out of engagement and pretension the same.

The magnetic force, the minimum overlap area, the bevels at the detent springs and the spring tension are adjusted such that the pretension of the detent spring deflected by the bevels of the detents is stronger than the remaining magnetic force in opening position with minimum overlap area, so that in the opening position the closure opens due to the detent springs acting as opening springs, which are pretensioned on opening, or due to the detent spring washer pretensioned on closing.

The person skilled in the art knows that the technical teaching according to claim 1 can be converted in a great variety of ways into concrete embodiments of magnetic closures, without an inventive activity being required for this purpose. Thus, the magnetic closure of the invention according to claim 1 can be used as a magnetic module for closures which are described e.g. in the document WO 002008006357 or DE 10 2007 033 277, in which magnetic closures have an additional mechanical lock. When opening the closure by laterally shifting armature and magnet, this lock is released. The number and size of the magnets used can be reduced when applying the technical teaching according to claim 1 and hence costs can be saved.

BRIEF DESCRIPTION OF THE DRAWINGS

The invention will be described in detail below with reference to embodiments in conjunction with the accompanying drawings. Herein.

FIG. 1*e* shows a sectional view of a rotary closure during the opening operation after rotation;

FIG. 1*f* shows a sectional view of a rotary closure during the opening operation after rotation and during ejection by the ejection mechanism;

FIG. 3*c* shows a linearly movable closure in a sectional view after opening;

FIG. 7*a-e* show an embodiment as bag closure;

FIG. 7*a* shows an exploded representation;

FIG. 7*b* shows the position of the sections A-A and B-B;

FIG. 7*c* shows the sectional representation A-A of the closure in the rest position;

FIG. 7*d* shows the sectional representation B-B of the closure in an actuated position shortly before opening;

FIG. 7*e* shows the sectional representation B-B of the closure shortly after opening.

FIGS. 8*a*-9*b* show a lineary movable configuration of a magnetic closure.

FIG. 8*a* shows a side and sectional view A-A of a linearly movable configuration of a magnetic closure;

FIG. 8*a*' shows the linearly movable configuration of the magnetic closure in the closing position of FIG. 9*b;*

FIG. 8*b*' shows the linearly movable configuration of the magnetic closure shortly before the open position;

FIG. 9*b* shows a perspective representation of both modules in the closed position.

DETAILED DESCRIPTION OF THE PREFERRED EMBODIMENTS

Figure 1A:
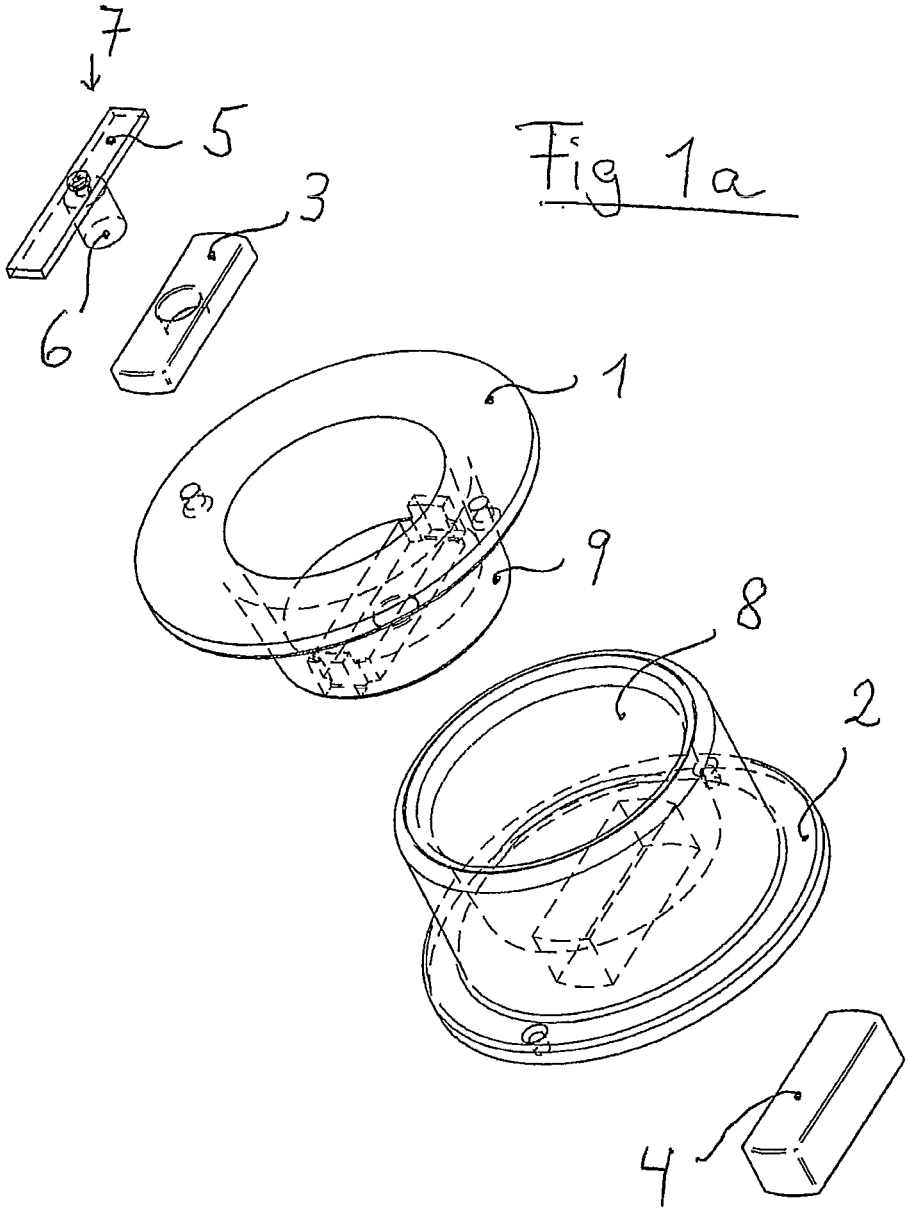
FIG. 1*a* shows an exploded representation of a rotary closure.
Figure 1B:
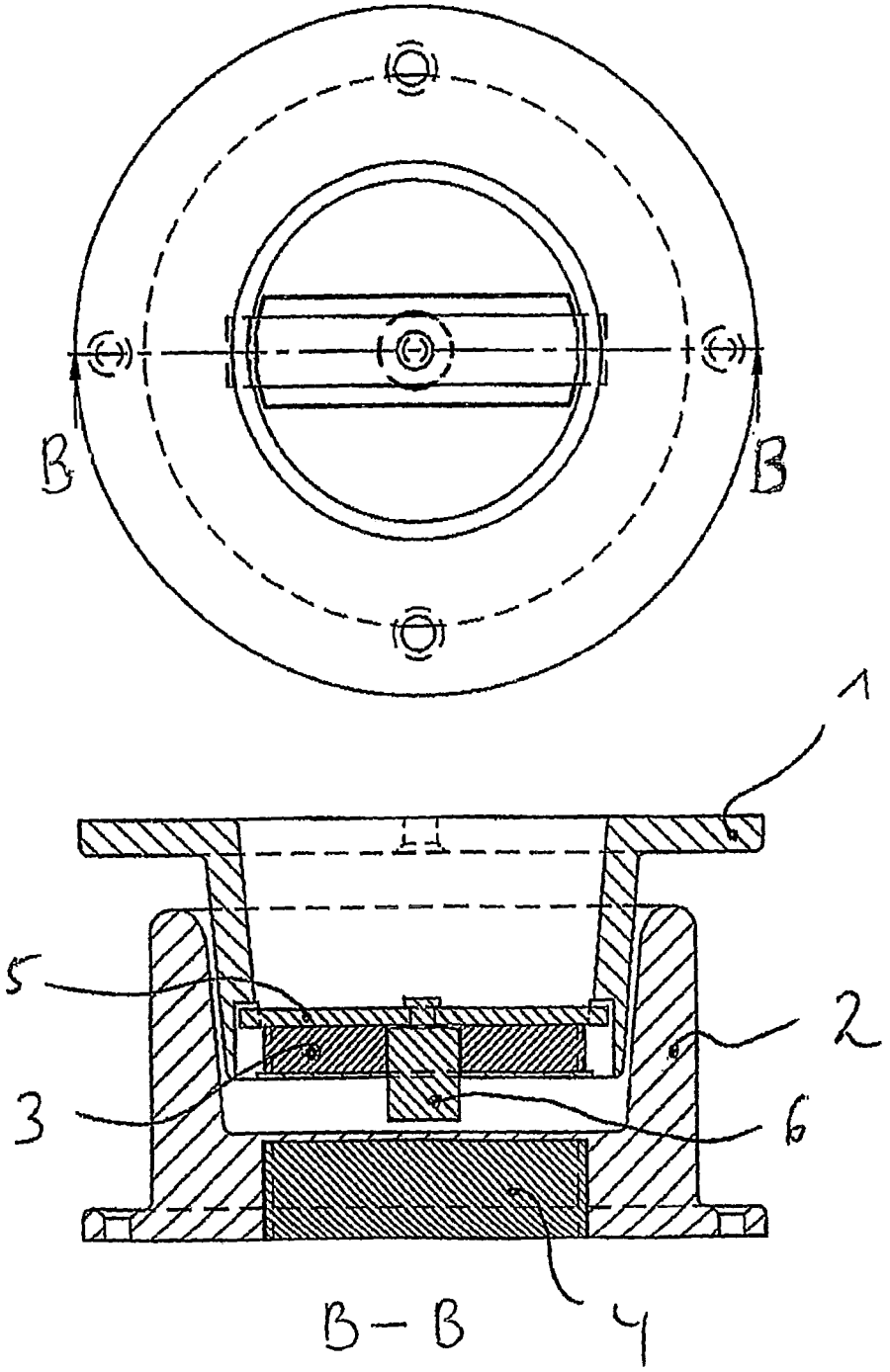
FIG. 1*b* shows a sectional representation of a rotary closure during the closing operation.
Figures 1C, 1D:
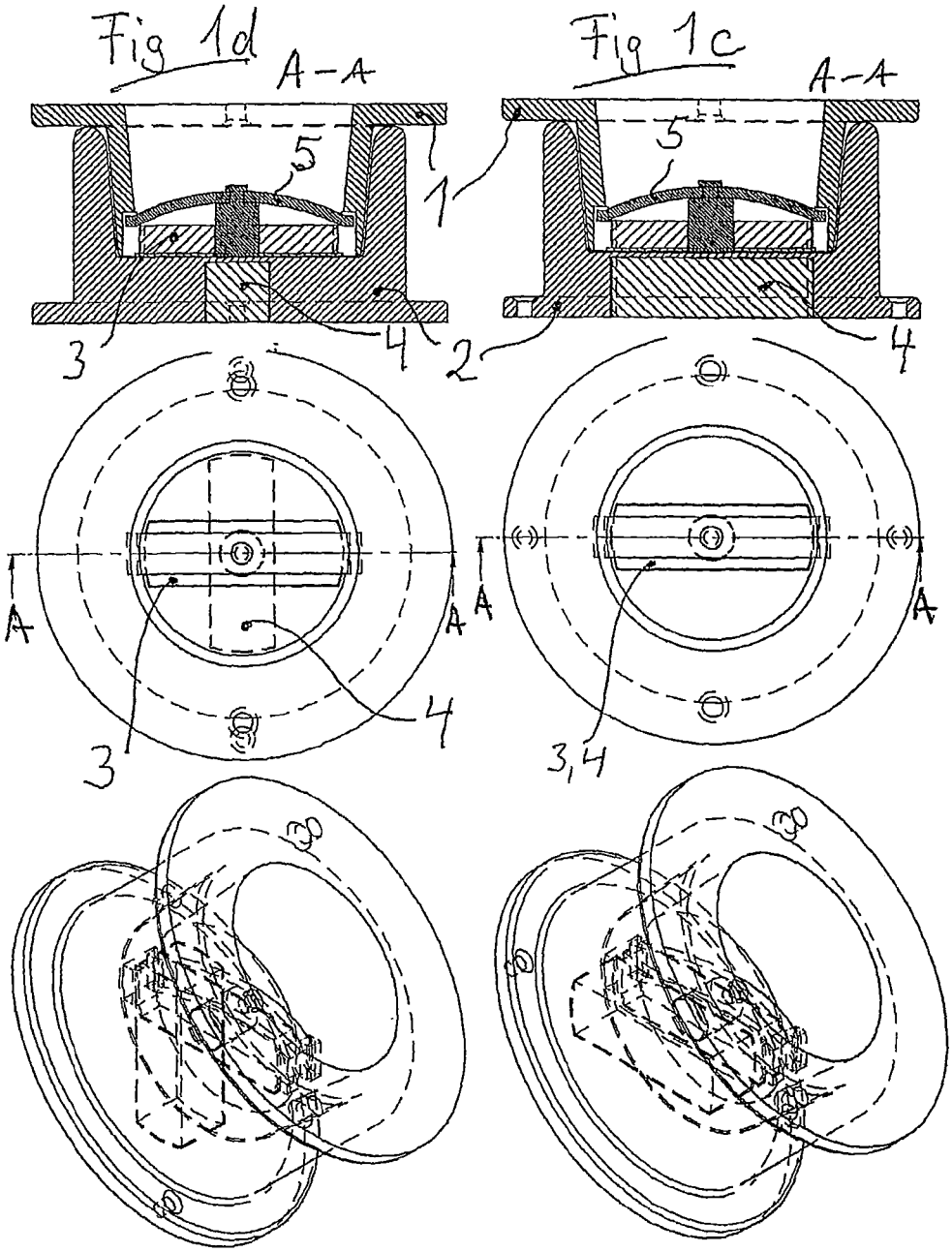
FIG. 1*c* shows a sectional and perspective view with concealed elements of a rotary closure in the closed position.
FIG. 1*d* shows a sectional and perspective view with concealed elements of a rotary closure during the opening operation after rotation.

FIG. 1*a* shows an embodiment comprising the connecting modules 1 and 2. Connecting modules 1 and 2 are guided by the guiding aids 8 and 9 so as to be rotatable against each other. In the connecting module 1, the armature 3 and the ejection mechanism 7 comprising a leaf spring 5 and an ejector pin 6 are mounted. In the connecting module 2 the magnet 4 is mounted. As shown in FIG. 1*b*, the ejector pin protrudes beyond the armature in the relaxed condition of the spring 5. The spring is dimensioned such that it is tensioned when armature and magnet have completely met, as shown in FIG. 1*c*. FIGS. 1*d* and 1*e* show that with a suitable geometry the overlap area of armature and magnet has become smaller after rotating armature and magnet and the magnetic attraction thus has reached the state of minimum attraction. The spring furthermore is dimensioned such that, as shown in FIG. 1*f*, it overcomes the residual attraction of magnet and armature and separates the magnetic closure.

The springing open of the magnetic closure thus has been achieved by rotating the connecting modules, which was perceived as haptically pleasant for the person actuating the closure.

Figure 2A:
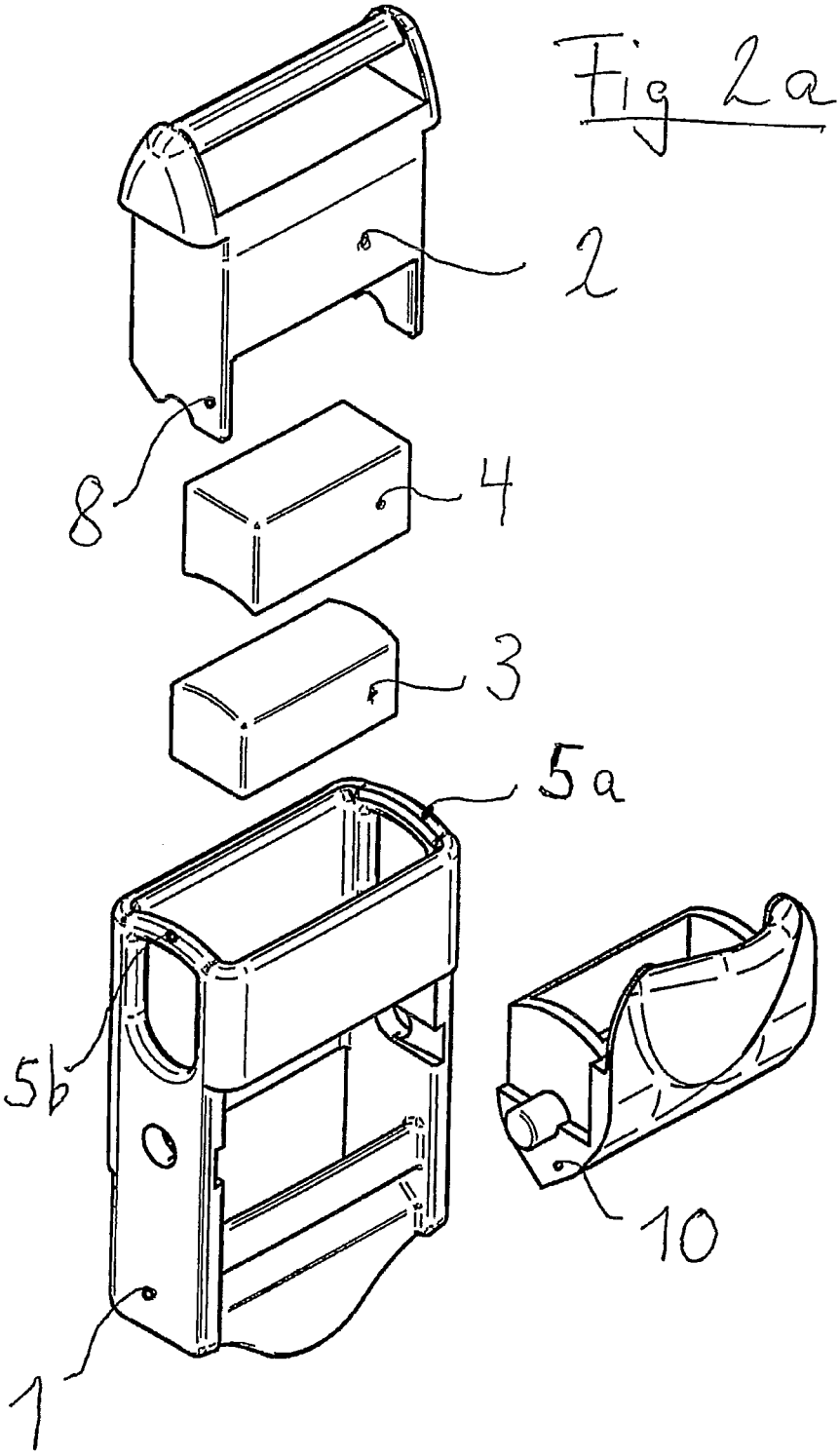
FIG. 2*a* shows an exploded representation of a snap buckle with tilting armature.
Figures 2B, 2C, 2D:
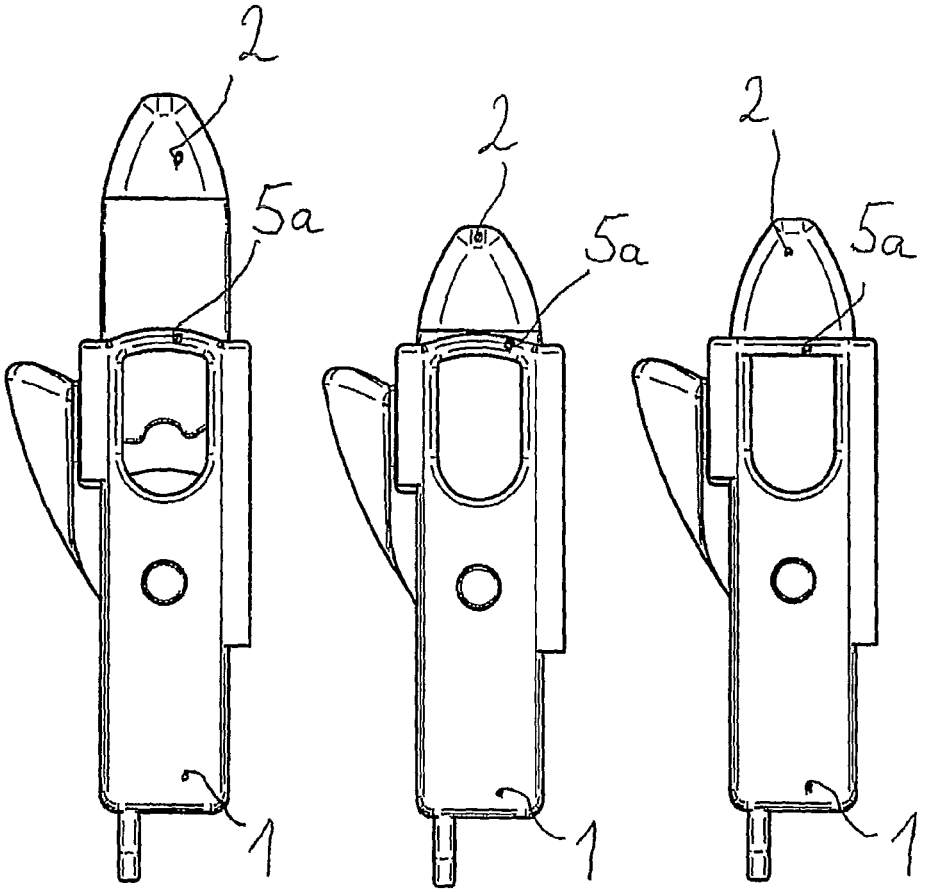
FIGS. 2*b*,2*c*,2*d* show the snap buckle in a side view during the closing operation.
Figure 2E:
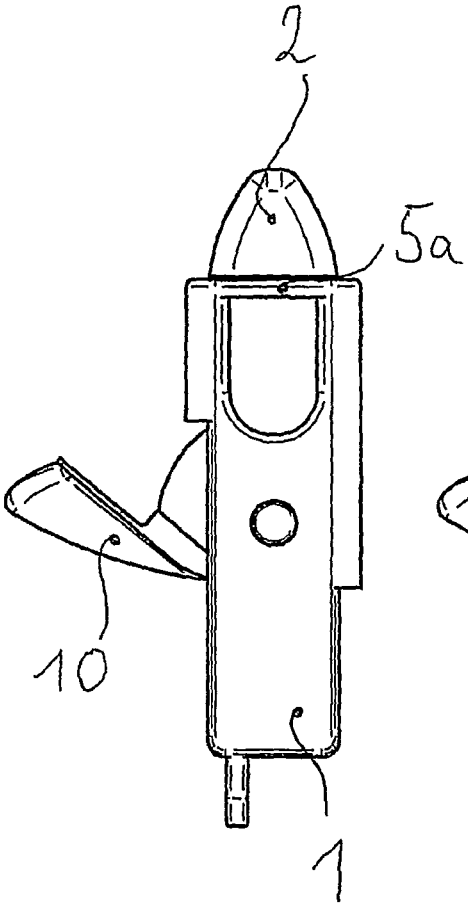
FIGS. 2*e*,2*f* show the snap buckle in a side view during the opening operation.
Figure 2F:
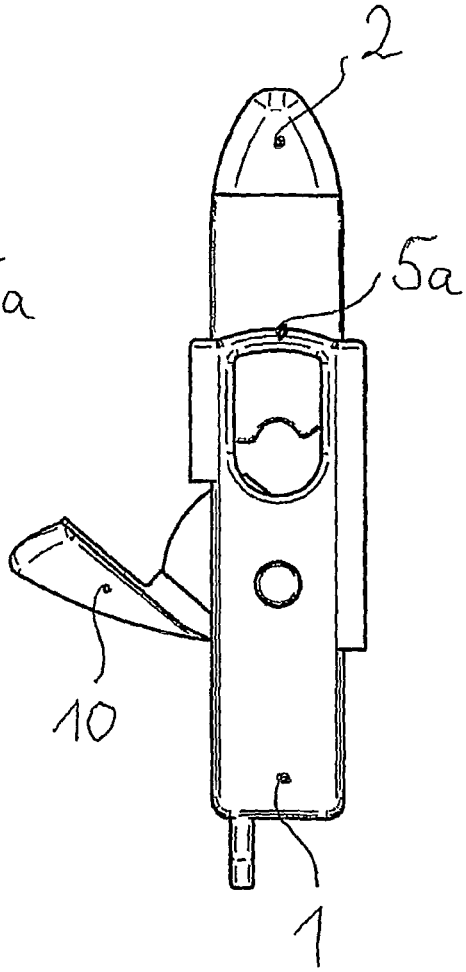

The snap buckle as shown in FIG. 2*a-f* is a further embodiment of the closure of the invention. Here, the connecting module 2 formed as plug is guided in the housing guideway 9 of the connecting module 1. In the connecting module 1, the tilting lever 10 with armature 3 is tiltably mounted. The ejection mechanism, i.e. the opening-assisting spring, here is formed by the spring portions 5*a*, 5*b* and supported by a slight deformability of the housing. FIGS. 2*a*-2*d* show how after insertion of the plug into the housing the plug is drawn into the housing by the magnetic force and the spring portions 5*a*, 5*b* are tensioned, i.e. straightened by the magnetic force. If the tilting lever 10 with the armature, as shown in FIGS. 2*e*, 2*f*, is tiltingly shifted from the magnet, the magnetic attraction is diminished to such an extent that the pretensioned spring force of the spring portions 5*a*, 5*b* is stronger than the remaining magnetic attraction between armature and magnet, so that the plug is ejected.

Figure 3A:
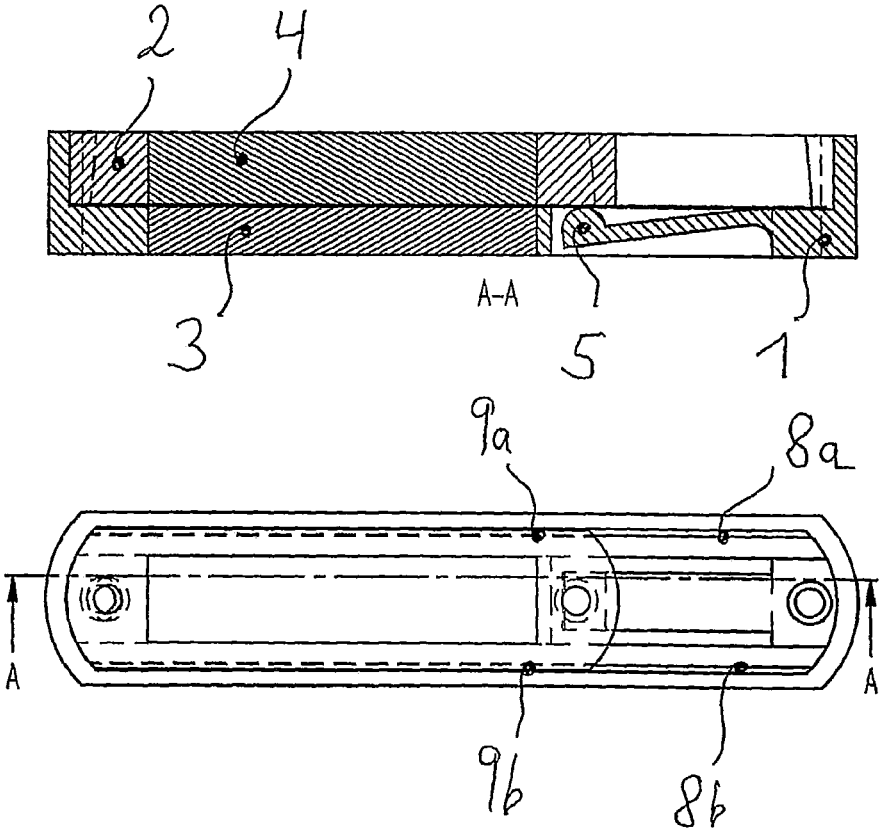
FIG. 3*a* shows a linearly movable closure in a sectional view in the closed position.

FIG. 3*a* shows an embodiment of a linearly movable magnetic closure.

By means of the guideways 8*a*, 9*a* and 8*b*, 9*b* the connecting modules 1 and 2 are guided in a linear direction of movement. The ejection mechanism is formed by the opening-assisting spring 5 which is tensioned in the illustrated closed condition.

Figure 3B:
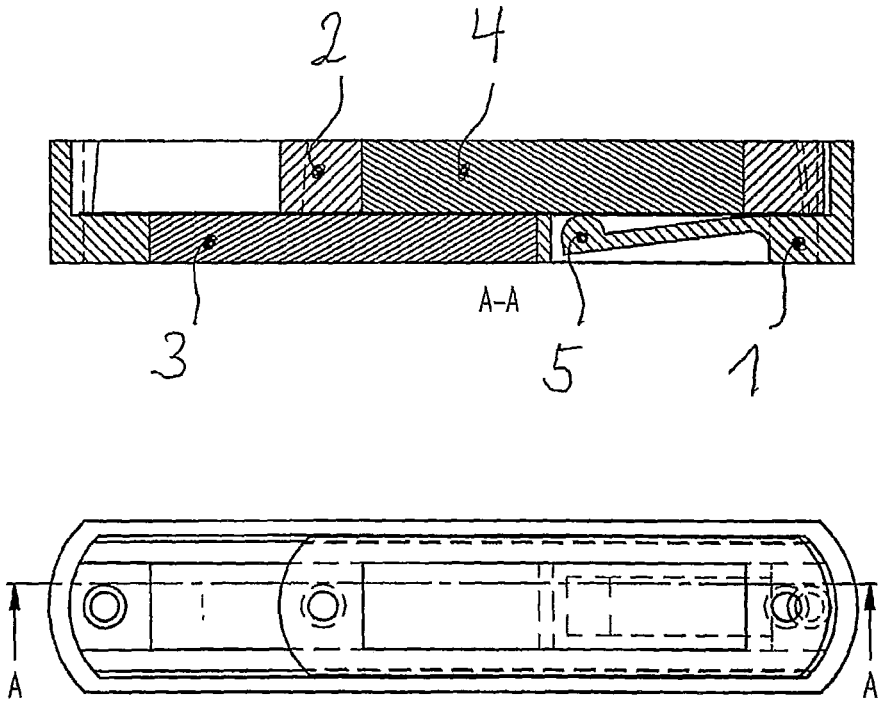
FIG. 3*b* shows a linearly movable closure in a sectional view after shifting.

FIG. 3*b* shows the closure after armature and magnet have been shifted against each other. FIG. 3*c* shows how after shifting in the position of minimum magnetic attraction the spring force of the ejection mechanism is greater than the force of attraction, so that the connecting modules 1 and 2 spring open.

The above description relates to an embodiment in which the pretensioning of the opening-assisting spring is effected during the closing operation.

In the following, the operation of the invention will be described with reference to FIGS. 4-6, when the pretensioning of the opening-assisting spring is effected during the shifting or rotation between magnet and armature, i.e. during the opening movement.

Figure 4A:
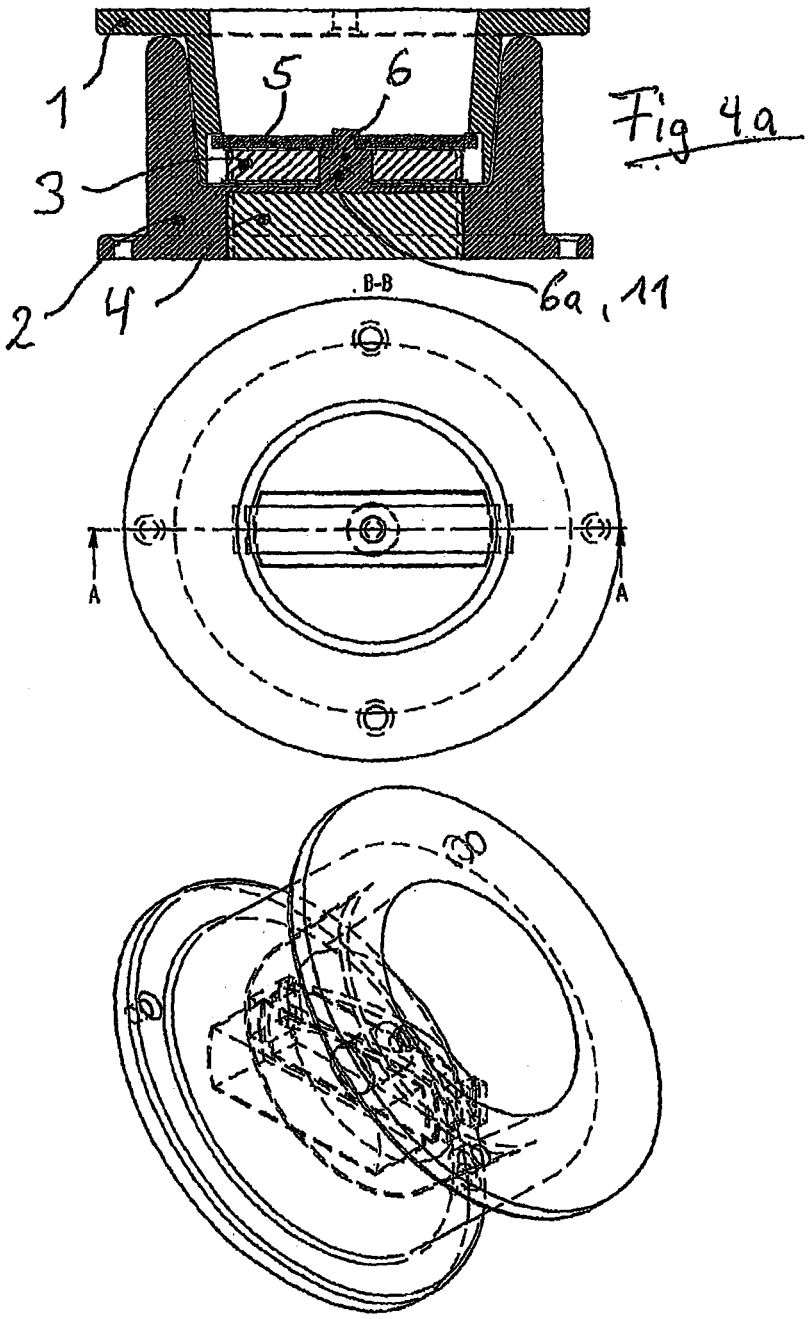
FIG. 4*a* shows a sectional and perspective view with concealed elements of a rotary closure in the closed position.

In detail, FIG. 4*a* shows the construction of the magnetic closure comprising the connecting modules 1 and 2. By means of the guiding aids 8 and 9, the connecting modules 1 and 2 are guided so as to be rotatable against each other from a predetermined distance. In the connecting module 1, the armature 3 and the ejection mechanism 7, consisting of leaf spring 5 and ejector pin 6, are mounted. In the connecting module 2, the magnet 4 is mounted. As shown in FIG. 4*a*, the ejector pin 6 does not protrude beyond the armature in the relaxed condition of the spring 5. On its bottom surface, the ejector pin 6 is provided with a screw surface 6*a*. This screw surface 6*a* impinges on the force-deflecting screw surface 11 provided at the connecting module 2. FIG. 4*d* shows how after the rotation of connecting module 1 and connecting module 2 the screw surfaces 6*a* and 11 have urged the contact pin against the spring, until the same is tensioned and the ejection mechanism comprising the spring 5 and the ejector pin 6 generates a force acting against the magnetic attraction.

Figure 4B:
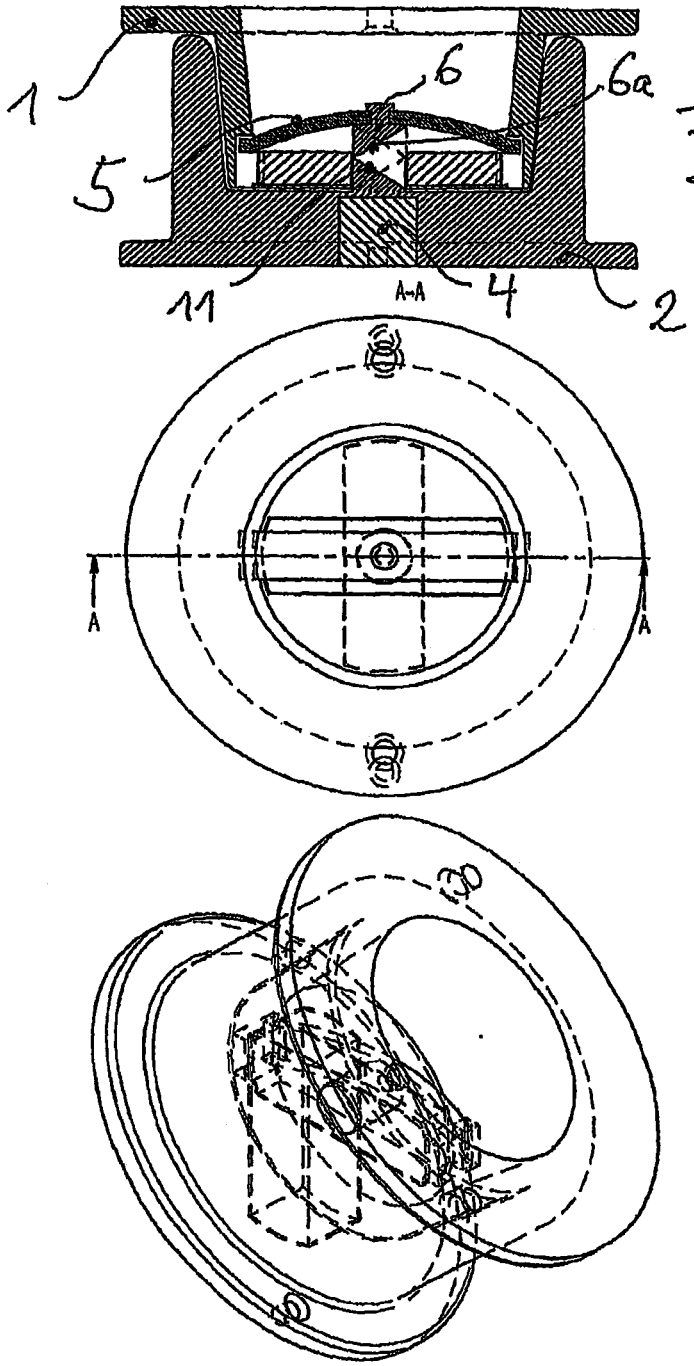
FIG. 4*b* shows a sectional and perspective view with concealed elements of a rotary closure after rotation.
Figure 4C:
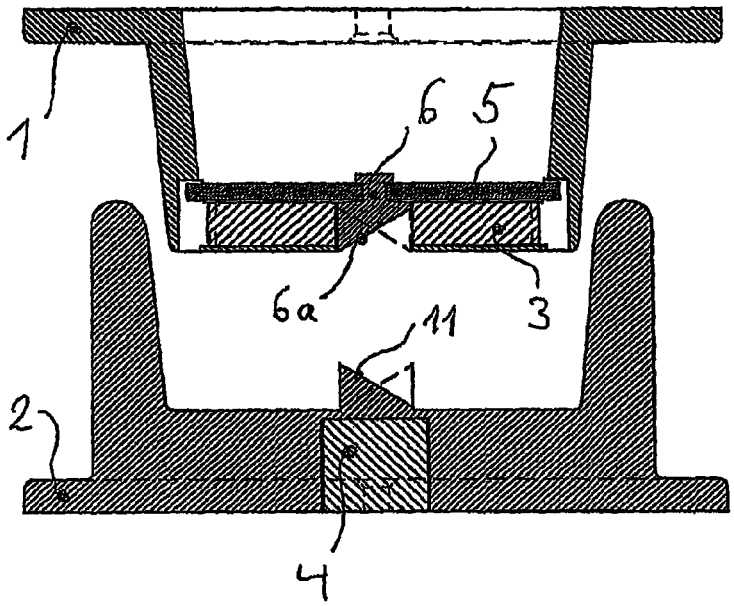
FIG. 4*c* shows a sectional view with concealed elements of a rotary closure during the opening operation after opening.
Figure 4D:
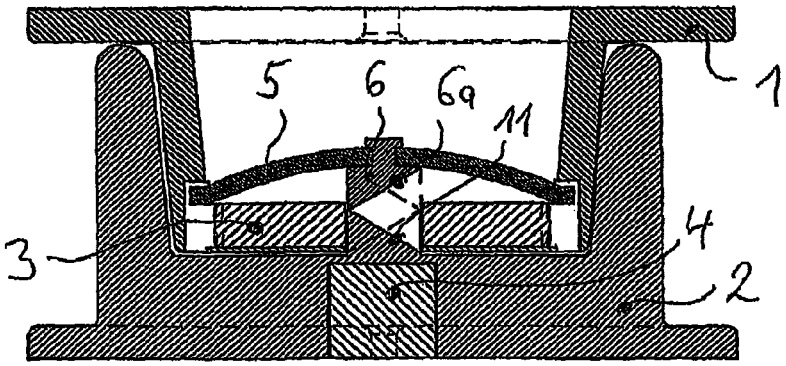
FIG. 4*d* shows a sectional view of a rotary closure during the opening operation after rotation.

In addition, FIGS. 4*b* and 4*d* show that with a suitable geometry of armature and magnet the overlap area of armature and magnet has become smaller after rotating and thus the magnetic attraction has reached the condition of minimum attraction. The spring furthermore is dimensioned such that, as shown in FIG. 4*c*, it overcomes the residual attraction of magnet and armature and pushes open the closure against the magnetic force, which is perceived as haptically pleasant.

Figure 5A:
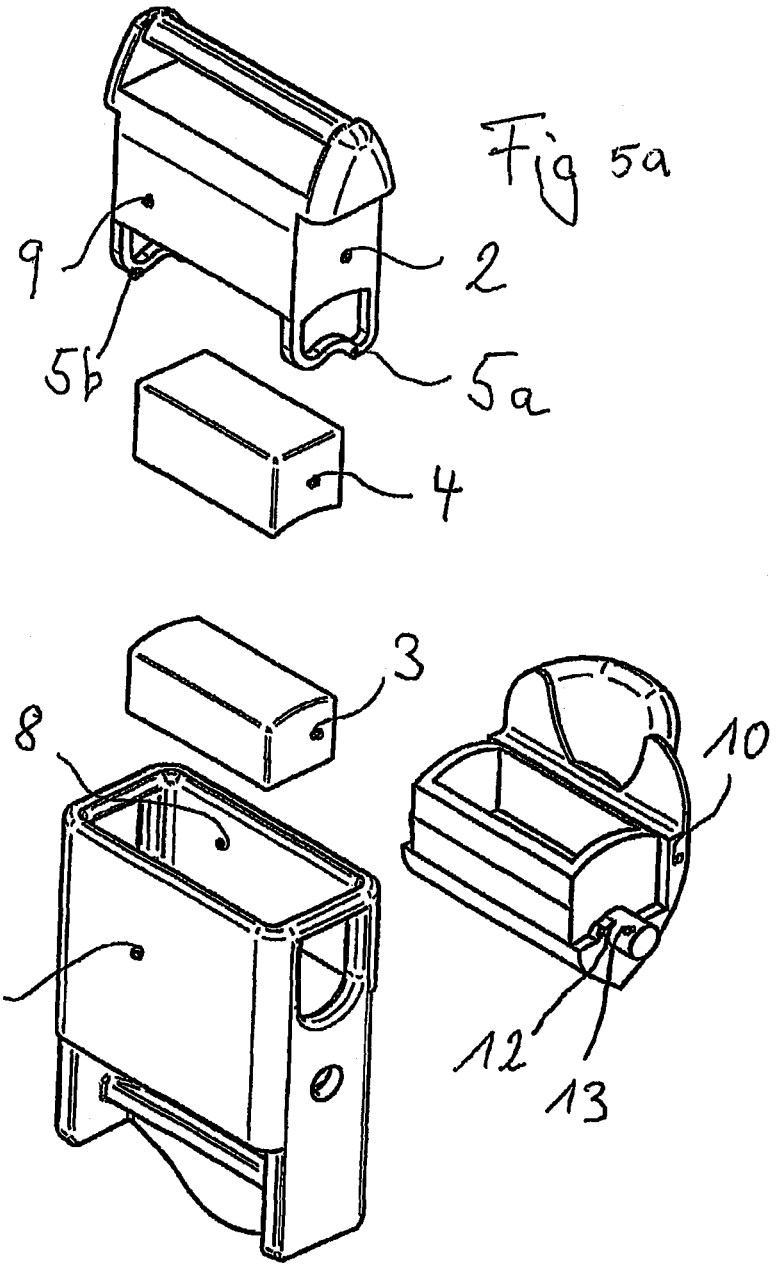
FIG. 5*a* shows an exploded representation of a snap buckle with a tilting armature.
Figure 5B:
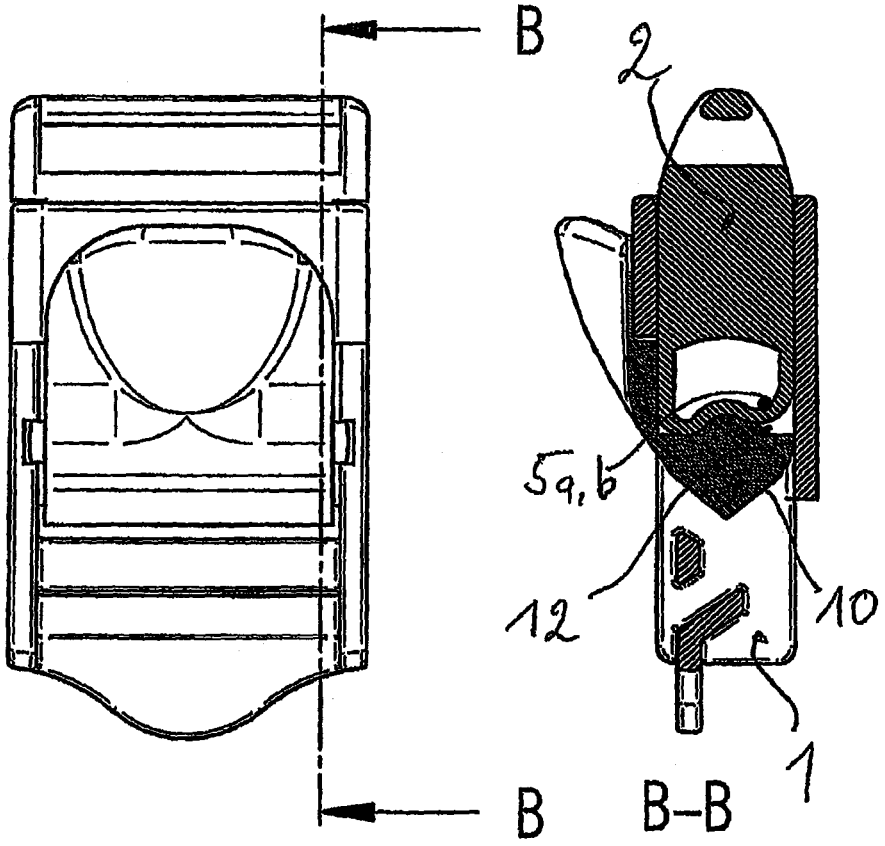
FIG. 5*b* shows a snap buckle in a sectional view in the closed position.
Figure 5C:
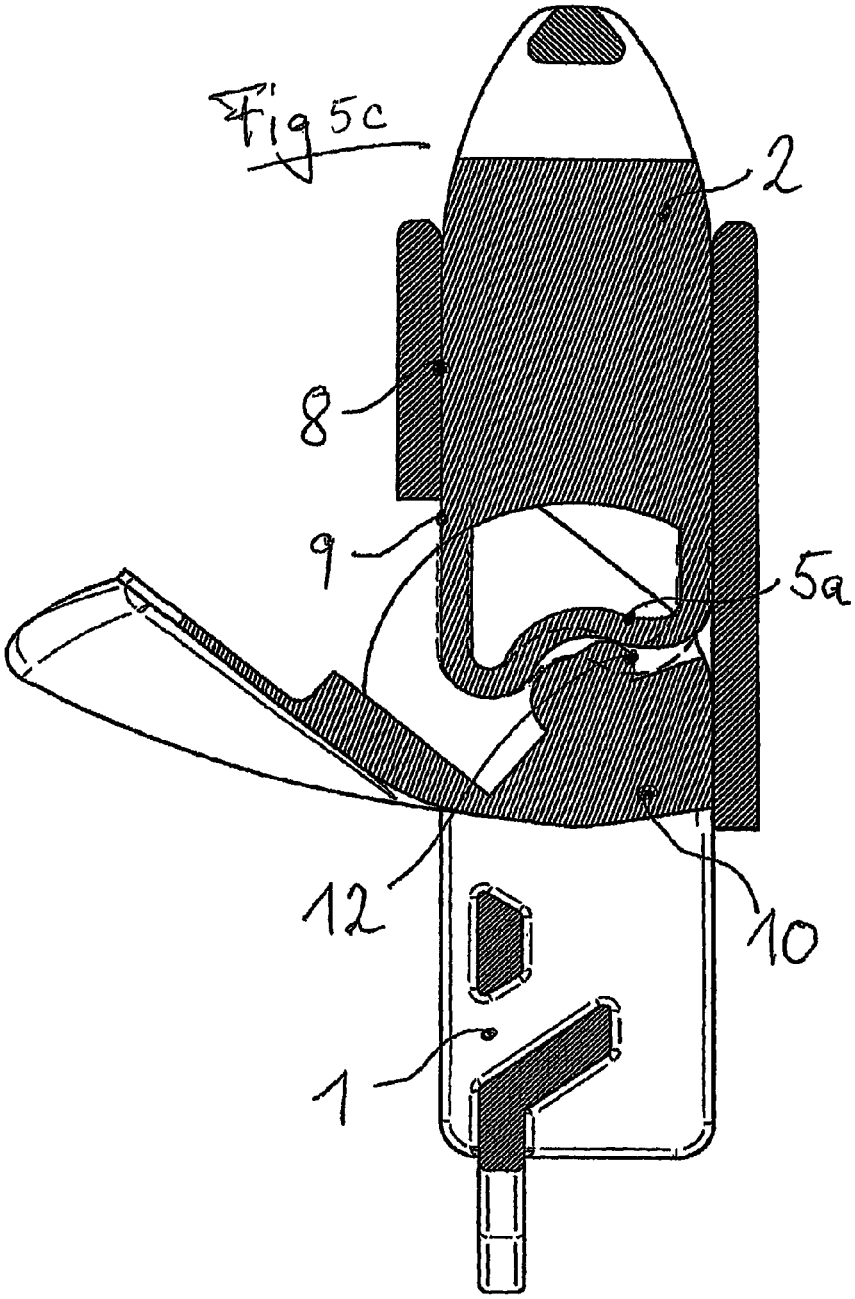
FIG. 5*c* shows a snap buckle in a sectional view on opening.

The snap buckle as shown in FIG. 5*a-c* is a further embodiment of the closure of the invention. Here, the connecting module 2 is formed as plug with the guide surfaces 9 and is guided in the housing guideway 8 in the connecting module 1. In the connecting module 1, the tilting lever 10 with the armature 3 is tiltably mounted on the axle 13.

The ejection mechanism here is formed by the opening-assisting springs 5*a, b*, which in the closed position rest on the axle 13 untensioned.

FIG. 5*c* shows how after tilting of the tilting lever 10 the spring portions 5*a*, 5*b* are tensioned by the eccentric 12. As a result, the plug is ejected in the direction of arrow, since the force of the ejection mechanism 7 is stronger than the remaining magnetic attraction. When the tilting lever 10 with the armature, as shown in FIGS. 5*b*, 5*c*, is tiltingly shifted from the magnet, the magnetic attraction is diminished to such an extent that the pretensioned spring force is stronger than the remaining magnetic attraction between armature and magnet, and the plug 2 is ejected.

Figure 6A:
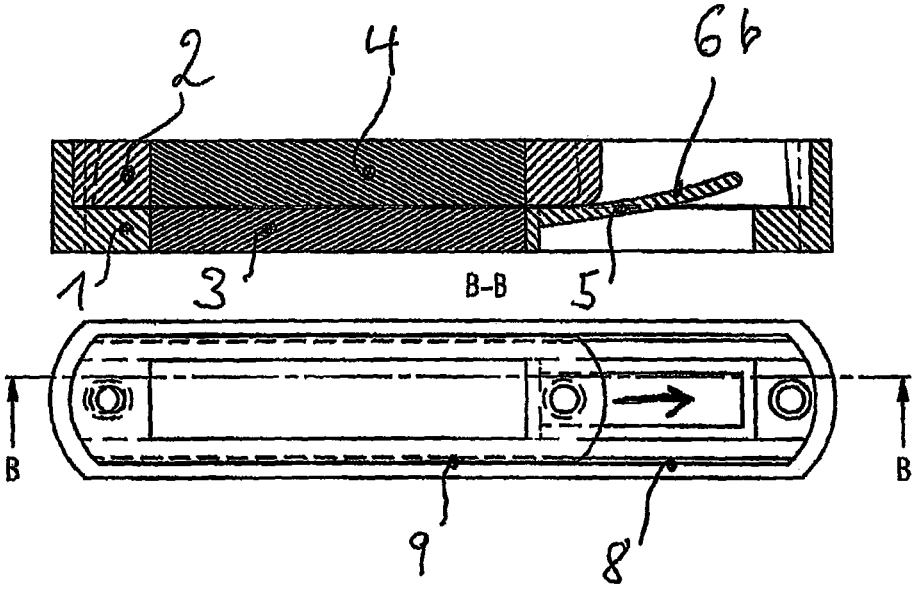
FIG. 6*a* shows a linearly movable closure in a sectional view in the closed position.

FIG. 6*a* shows an embodiment of a linearly movable magnetic closure.

The connecting modules 1 and 2 are guided by the guideways 8*a*, 9*a* and 8*b*, 9*b* in a linear direction of movement in the direction of arrow. The ejection mechanism comprising the spring 5 is relaxed in the illustrated closed condition.

Figure 6B:
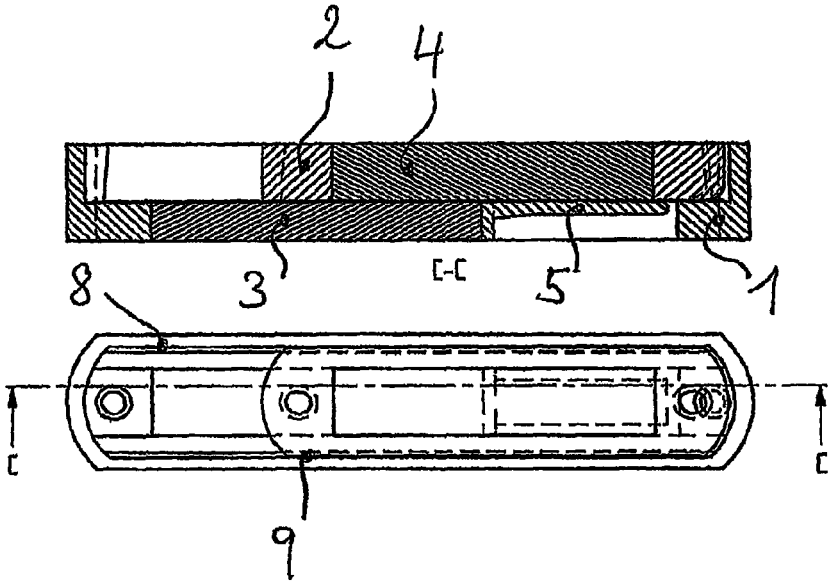
FIG. 6*b* shows a linearly movable closure in a sectional view after shifting.
Figure 6C:
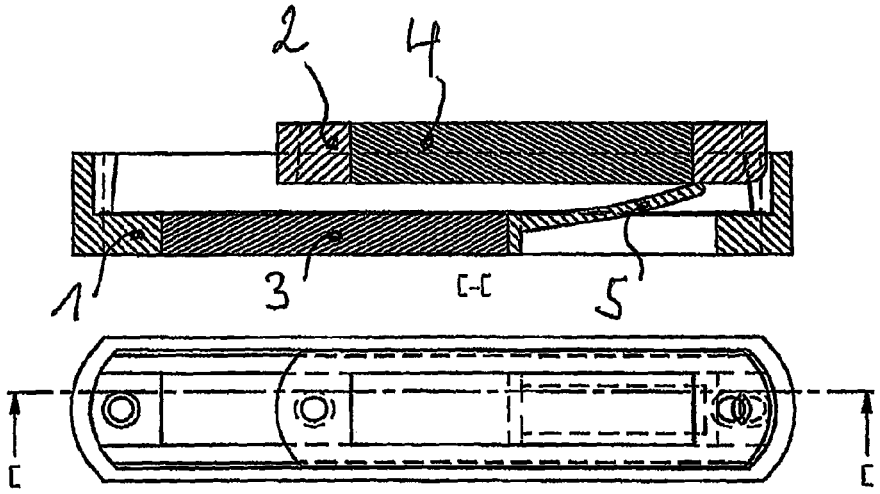
FIG. 6*c* shows a linearly movable closure in a sectional view after opening.
Figure 6D:
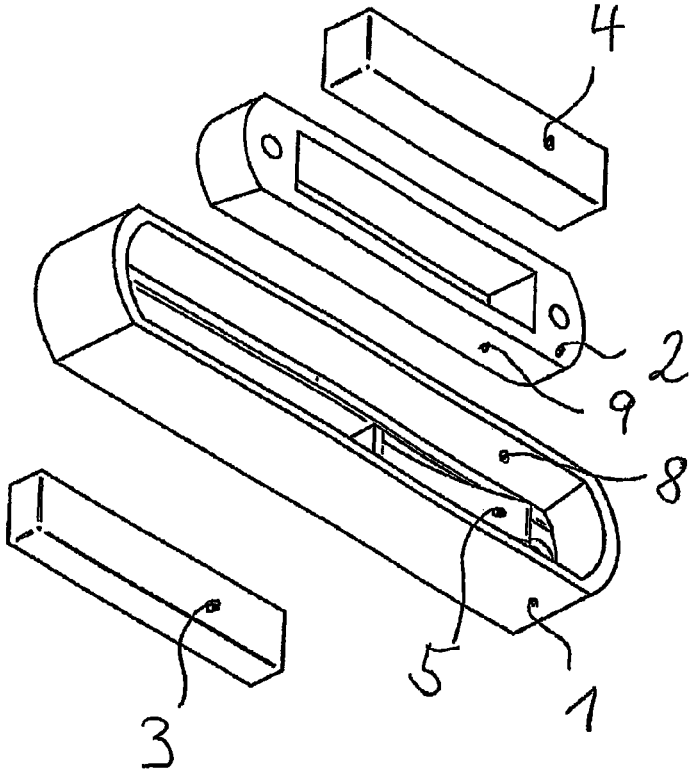
FIG. 6*d* shows a linearly movable closure in an exploded representation.

FIG. 6*b* shows how after shifting of the connecting modules 1, 2 the armature and the magnet are brought into the position of minimum attraction and the spring 5 of the ejection mechanism has been tensioned during shifting by means of the working surface 6*b* of the spring 5 disposed at an angle to the shifting direction. FIG. 6*c* shows how after shifting into the position of minimum magnetic attraction the spring force of the ejection mechanism is greater than the force of attraction and the closure springs open.

Figure 7A:
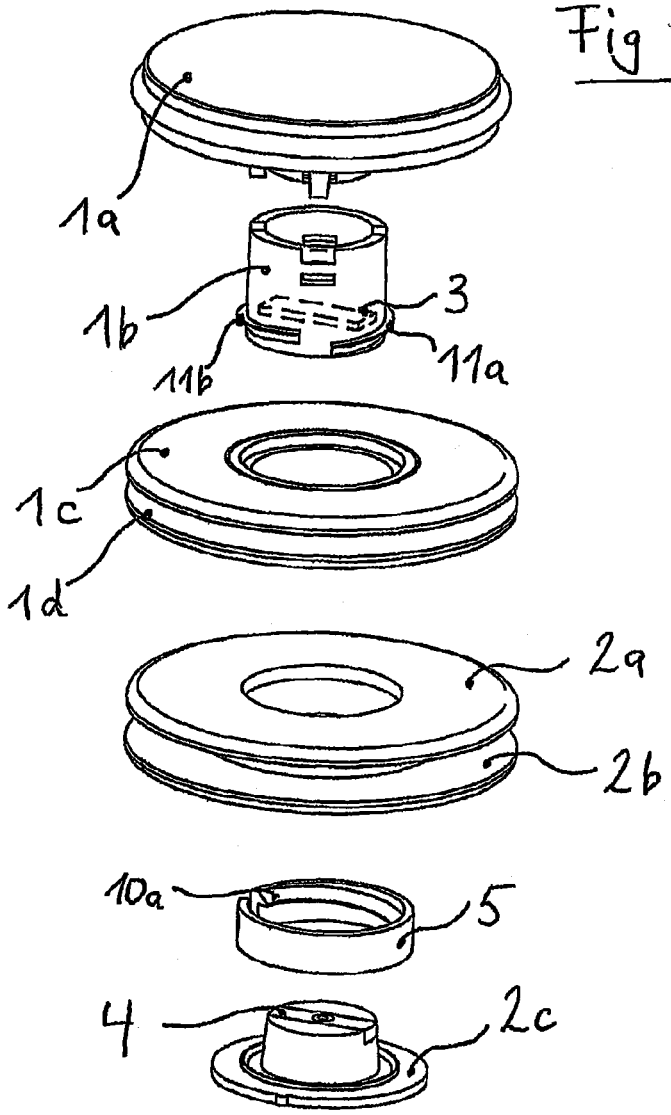
Figure 76:
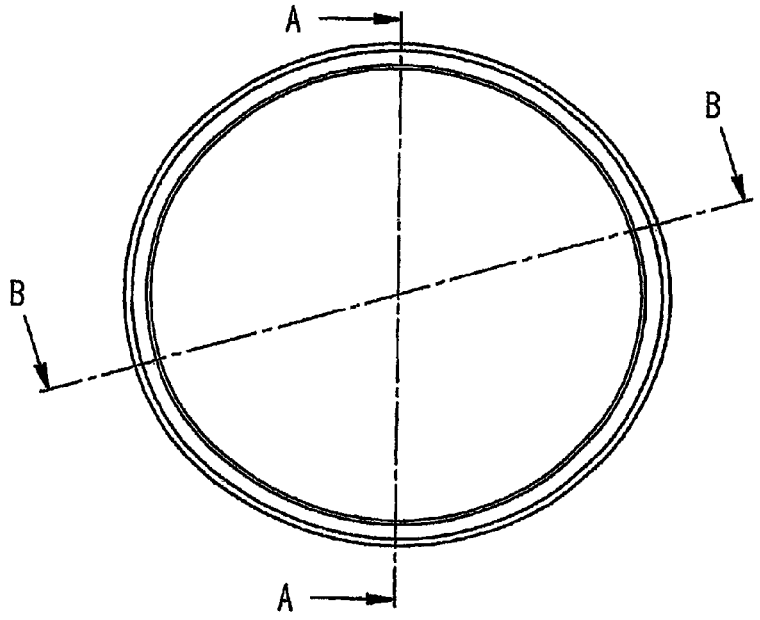

FIGS. 7*a-d* show a further special embodiment as a bag closure according to claim 4. Here, the opening spring is configured as a thread-detent closure spring, which will be explained below:

FIG. 7*a* shows an exploded representation of all individual parts:

- In the upper collar 1*d* the rotary part 1*a* is mounted. The collar ring 1*c* serves for fixing e.g. in the fabric layer of a bag cover.
- The rotary lever 1*a* is put onto the rotary part 1*b*.
- In the rotary part 1*b* the rectangular armature 3 is arranged as well as the beveled flights 11*a*,11*b*.
- In the closed position, these flights 11*a,b* have snapped in engagement behind the flights 10*a,b* of the locking ring 5 acting as opening spring.
- In the foot part 2*c* the magnet 4 is arranged, which in the rest position faces the armature 3.
- The foot part is mounted in the lower collar 2*a*. The lower collar ring 2*b* serves for fixing e.g. in the fabric layer of a bag body.

Figure 7C:
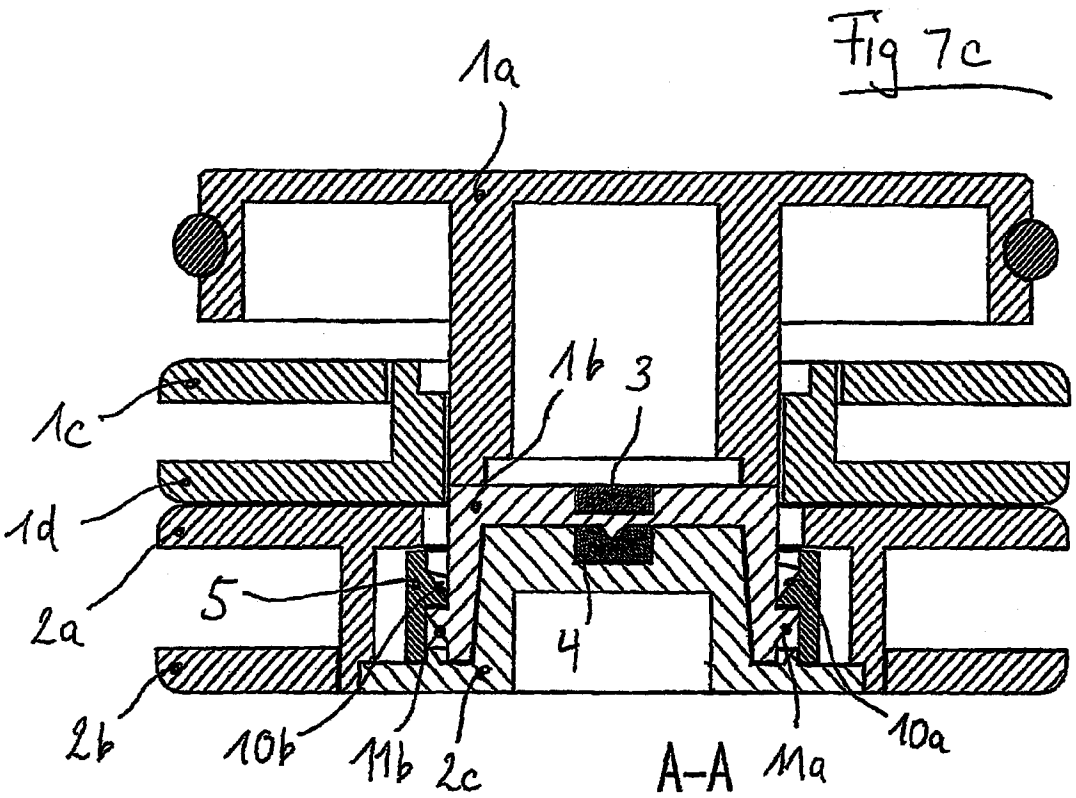

FIG. 7*b* shows the position of the sections A-A and B-B. FIG. 7*c* shows the sectional representation A-A of the closure in the rest position in which magnet 4 and armature 3 face each other with a maximum overlap area. On closing, the magnetic attraction between armature 3 and magnet 4 had spread open the locking ring 5 by means of the beveled flights 10*a,b* and 11*a,b*, until the flights 11*a,b* of the rotary part finally have snapped behind the flights 10*a,b* of the locking ring and have achieved a positive connection of connecting module A and connecting module B.

Figure 7D:
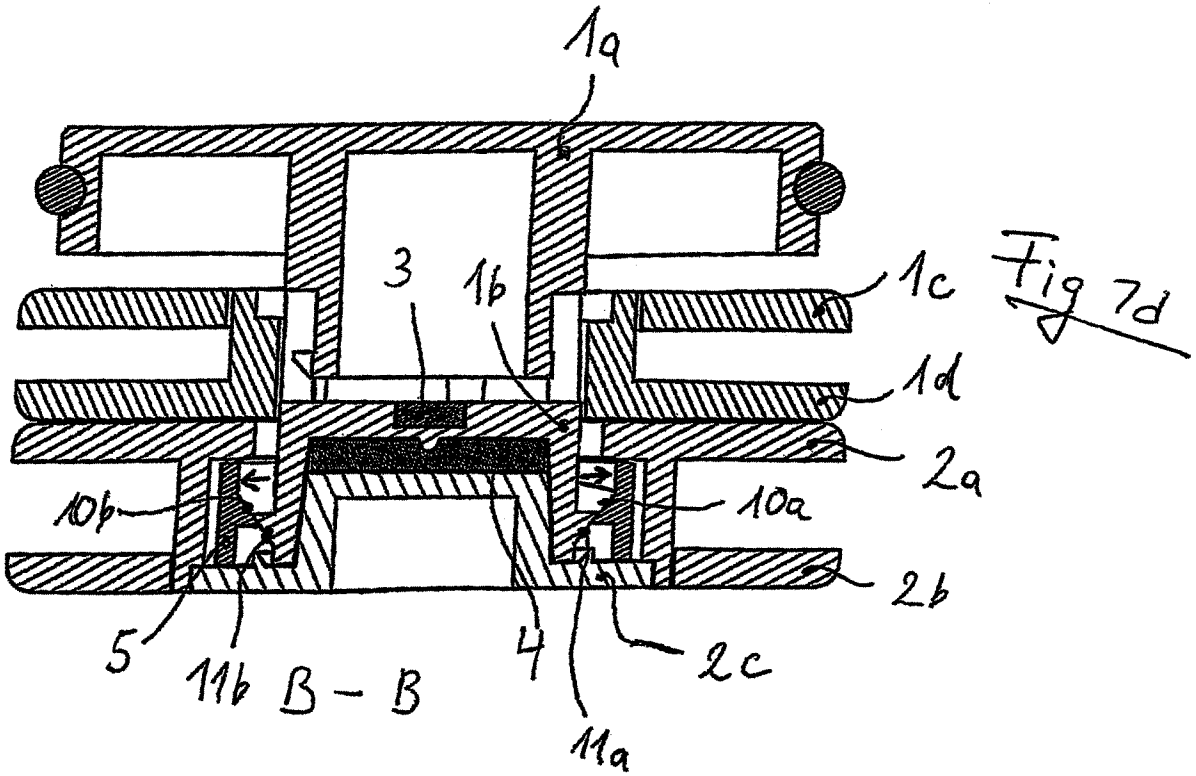
Figure 7E:
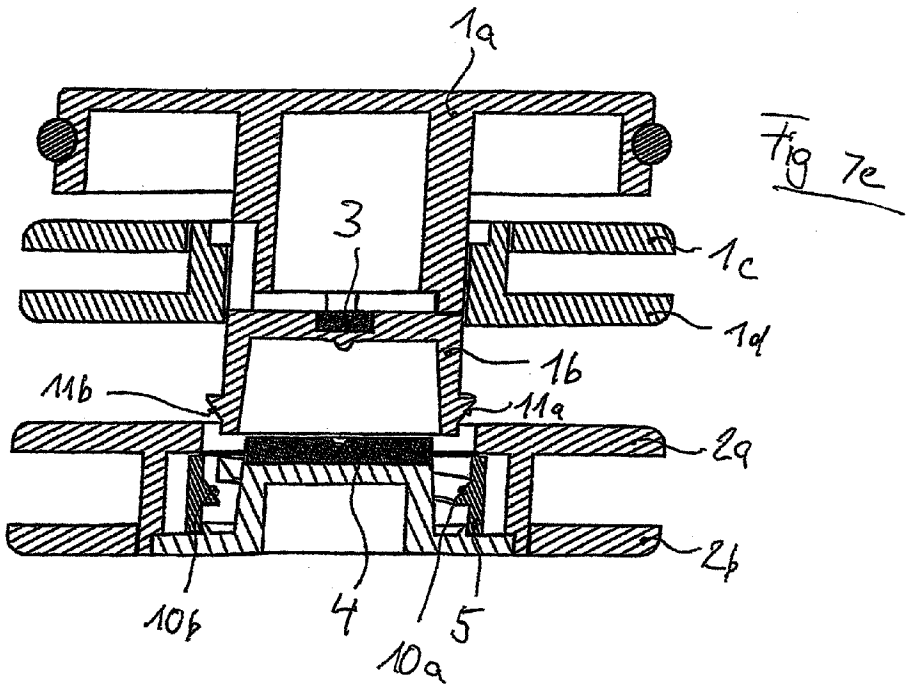

FIG. 7*d* shows the sectional representation B-B of the closure in an actuated position shortly before opening. Here, the rotary part 1*b* has been rotated by means of the rotary handle 1*a* to such an extent that the armature 3 only minimally overlaps the magnet 4 and hence the magnetic attraction has been weakened considerably. In addition, the rotation has effected that during the rotation the beveled flights 11*a,b* of the rotary part 1*b* have urged apart the beveled flights 10*a,b* of the locking ring 5 in the direction of arrow. As can be seen, the interaction of the beveled flights 10*a,b* and 11*a,b* with the pretension of the locking ring now produces an ejection force acting against the magnets. In the open position, magnetic force and spring force are predetermined such that this ejection force is greater than the remaining magnetic force between armature and magnet and thus opens the closure.

Figure 9A:
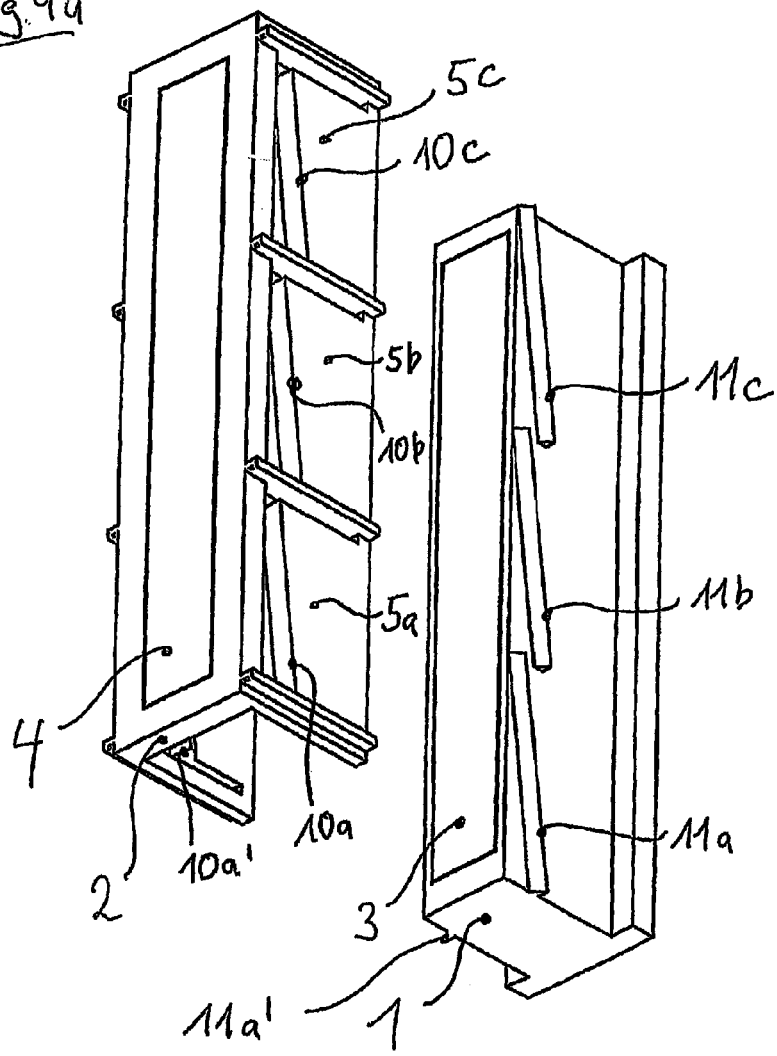
FIG. 9*a* shows a perspective representation of both modules.

FIGS. 9*a,b* and 8*a,b* show a linearly movable configuration of the magnetic closure with an opening spring according to claim 4, in which the first connecting module 1 and the second connecting module 2 are linearly shifted against each other.

FIG. 9*a* shows both modules in a perspective view. In the connecting module 1 the magnet 4 is mounted. In addition, the beveled spring catches 10*a*, 10*b*, 10*c*, 10*a*', 10*b*', 10*c*' are provided in the connecting module 1. In the connecting module 2, the armature 3 as well as the beveled detent lugs 11*a*, 11*b*, 11*c*, 11*a*', 11*b*', 11*c*' are arranged. The beveled spring catches 10*a*, 10*b*, 10*c*, 10*a*', 10*b*', 10*c*' as well as the beveled detent lugs 11*a*, 11*b*, 11*c*, 11*a*', 11*b*', 11*c*' are arranged in a rising manner.

Figure 9B:
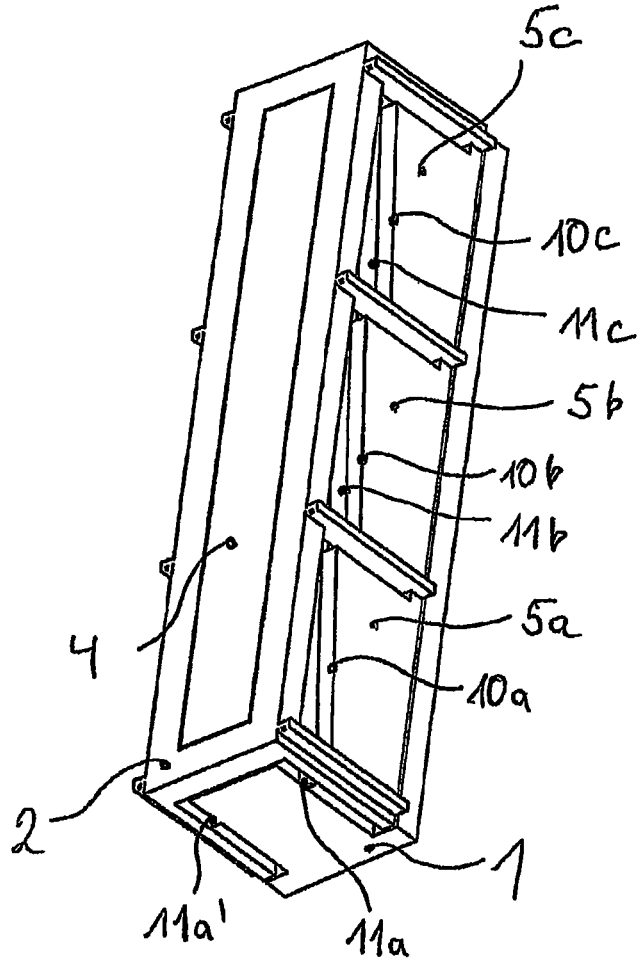

FIG. 9*b* shows a perspective view of the connecting modules in the closed position. Due to the magnetic attraction of magnet and armature, which face each other with a maximum overlap area, the beveled spring catches 10*a*, 10*b*, 10*c*, 10*a*', 10*b*', 10*c*' have snapped behind the beveled detent lugs 11*a*, 11*b*, 11*c*, 11*a*', 11*b*', 11*c*'.

Figure 8A:
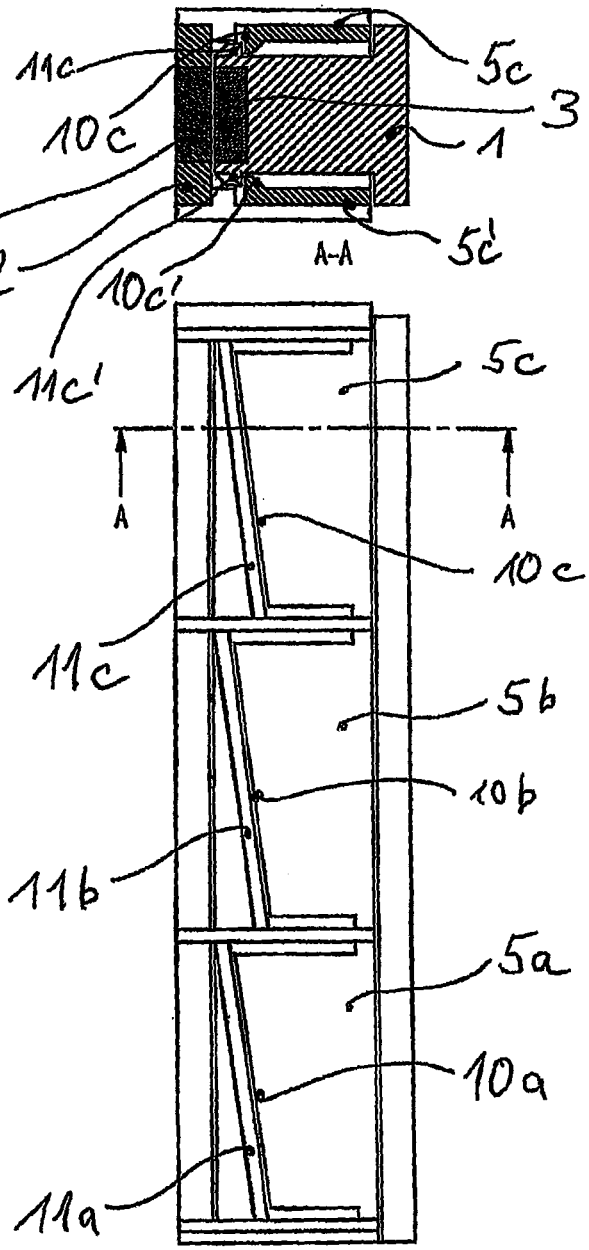
Figure 8A:
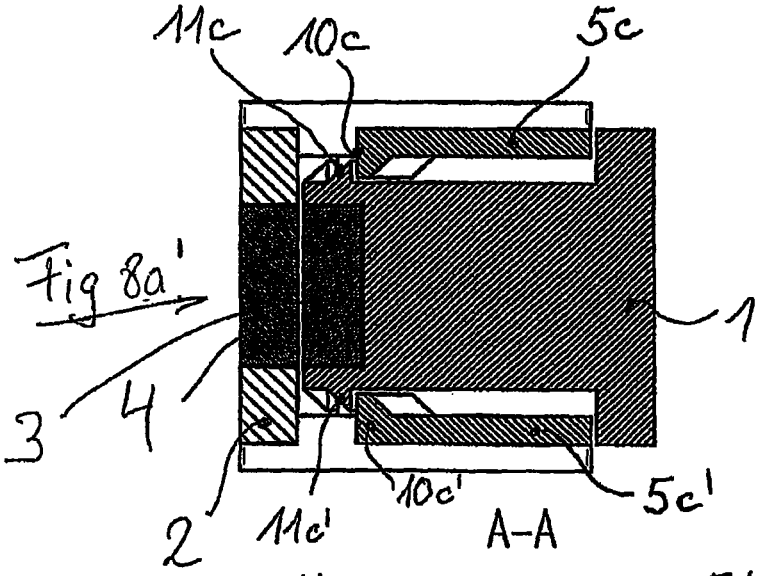
Figure 8B:
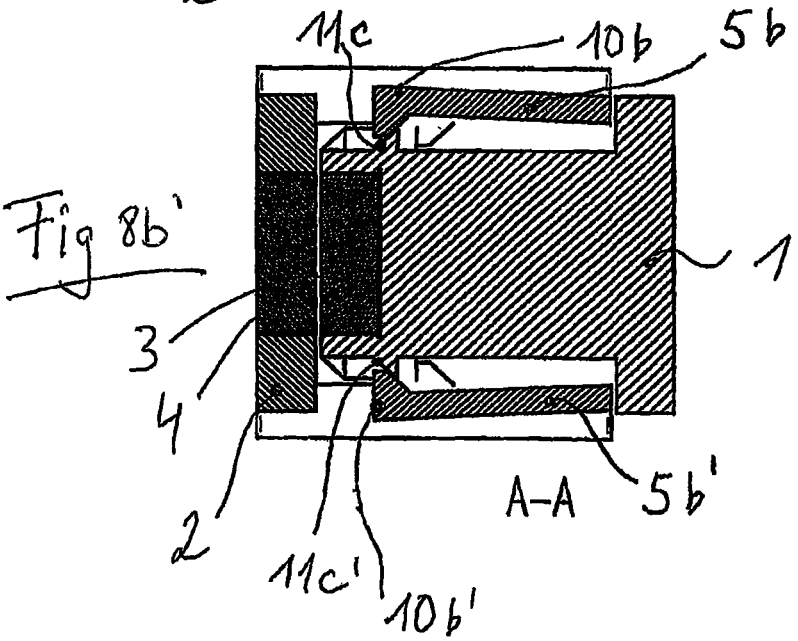
FIG. 8*b* shows a side and sectional view A-A of the magnetic closure.
Figure 8B:
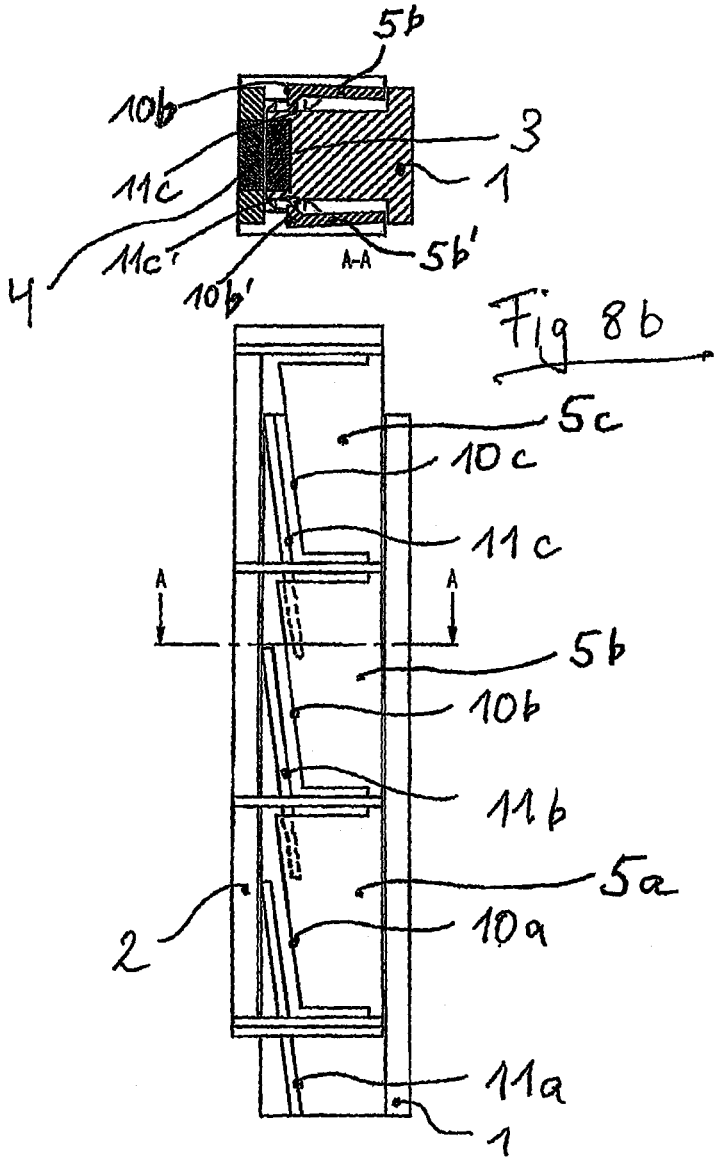

FIG. 8*a* shows a side and sectional view A-A of the magnetic closure in the closed position of FIG. 9*b*.

FIG. 8*a* shows a side and sectional view A-A of the magnetic closure shortly before the open position after linear shifting.

Here, the connecting modules 1 and 2 have been shifted against each other in the direction of the pitch of the detent lugs to such an extent that during shifting the beveled, rising detent lugs 11*b*, 11*c*, 11*b*', 11*c*' have gradually pushed open the beveled spring catches 10*a*, 10*b*, 10*a*', 10*b*' with their bevels into a tensioned position. As can be seen, an ejection force acting against the magnets now is obtained due to the interaction of the beveled spring catches 10*a*, 10*b*, 10*a*', 10*b*' and the beveled detent lugs 11*b*, 11*c*, 11*b*', 11*c*' with the pretension of the spring catches 10*a*, 10*b*, 10*a*', 10*b*'. In the open position, magnetic force and spring force are adjusted to each other such that this ejection force is greater than the remaining magnetic force between armature and magnet and thus opens the closure.

For better clarity, the sectional drawings of FIG. 8*a*, the closed position and 8*b*, the open position, are again compared with each other on an enlarged scale on a separate sheet as FIGS. 8*a*' and 8*b*'.

It should be emphasized that the spring catch 11*b* is pushed open by the detent lug 11*c* and 10*a* by 11*b*, i.e. the closure of the invention always requires a plurality of spring catches, which each are pushed open by the adjacent detent lug, and would not work with a single spring catch. Here, the advantage of the embodiment as a thread with at least two flights becomes obvious: there is no free end, i.e. all spring catches are used both as positively locking elements and as opening-assisting springs, whereas in the linear configuration always free ends are left.

The invention claimed is:

1. A magnetic closure with a magnet-armature structure, comprising:

a first closure member having a magnet;

a second closure member having an armature, the magnet and the armature being constituted such that, for an automatic closing, the armature and the magnet mutually attract each other in a closing direction below a predetermined minimum distance, wherein for opening the magnetic closure the magnet is moved with respect to the armature into an open position so that the surfaces of the magnet and the armature facing each other in a mutually attracting manner become smaller, whereby the force of attraction between magnet and armature becomes smaller; and an opening-assisting spring for assisting the opening, the opening-assisting spring being arranged on one of the first and the second closure member, wherein the opening-assisting spring is pretensioned during an opening operation, wherein the opening-assisting spring comprises an ejector pin attached thereto and is constituted such that a movement of the magnet with respect to the armature causes said ejector pin to be moved relative to a surface of the other of the first and the second closure member, thereby pretensioning the opening-assisting spring, and wherein the ejector pin, during the opening operation, is in contact with the surface of the other of the first and second closure member.

2. The magnetic closure according to claim 1, wherein the magnetic closure is formed such that the acting spring force of the opening-assisting spring is greater than the magnetic force of attraction in the open position.

* * * * *